US006433745B1

(12) United States Patent
Nagumo et al.

(10) Patent No.: US 6,433,745 B1
(45) Date of Patent: Aug. 13, 2002

(54) SURFACE-MOUNTED ANTENNA AND WIRELESS DEVICE INCORPORATING THE SAME

(75) Inventors: Shoji Nagumo, Kawasaki; Kazunari Kawahata, Machida; Nobuhito Tsubaki, Shiga-ken; Kengo Onaka, Yokohama; Takashi Ishihara, Machida, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/832,714

(22) Filed: Apr. 11, 2001

(30) Foreign Application Priority Data

Apr. 11, 2000 (JP) ..... 2000-108851

(51) Int. Cl.[7] ..... H01Q 1/38

(52) U.S. Cl. ..... 343/700 MS; 343/702; 343/873; 343/895

(58) Field of Search ..... 343/700 MS, 702, 343/846, 848, 873, 895, 893

(56) References Cited

U.S. PATENT DOCUMENTS 5,861,854 A * 1/1999 Kawahata et al. ... 343/700 MS
5,867,126 A * 2/1999 Kawahata et al. ... 343/700 MS
5,959,582 A * 9/1999 Kawahata et al. ... 343/700 MS
6,100,849 A * 8/2000 Tsubaki et al. ..... 343/700 MS
6,133,889 A * 10/2000 Yarsunas et al. ..... 343/792.5
6,281,848 B1 * 8/2001 Nagumo et al. ..... 343/700 MS
6,320,545 B1 * 11/2001 Nagumo et al. ..... 343/700 MS
6,323,811 B1 * 11/2001 Tsubaki et al. ..... 343/700 MS

FOREIGN PATENT DOCUMENTS

JP 02001217631 A * 8/2001 ..... H01Q/1/38

* cited by examiner

*Primary Examiner*—Don Wong
*Assistant Examiner*—Shih-Chao Chen
(74) *Attorney, Agent, or Firm*—Ostrolenk, Faber, Gerb & Soffen, LLP

(57) ABSTRACT

A multi-band surface-mounted antenna is formed by disposing a feeding element and a non-feeding element with a distance therebetween on a dielectric base member. The feeding element is formed by extending a feeding radiation electrode from a feeding terminal. The non-feeding element is a branched element formed by branching and extending a first radiation electrode and a second radiation electrode of the non-feeding side from a ground terminal side. The single surface-mounted antenna includes the three radiation electrodes. Thus, the antenna can be easily adapted to multi-bands. In addition, the resonance waves of the three radiation electrodes can be controlled mutually independently. As a result, only a frequency band selected from a plurality of required frequency bands is brought into a multi-resonance state so that the frequency band can be broadened.

38 Claims, 7 Drawing Sheets

SURFACE-MOUNTED ANTENNA AND WIRELESS DEVICE INCORPORATING THE SAME

BACKGROUND OF THE INVENTION

1. Field of the Invention

The present invention relates to surface-mounted antennas capable of transmitting and receiving the signals of different frequency bands and wireless devices incorporating the same.

2. Description of the Related Art

Recently, there has been a demand for wireless devices on the market, in which a single wireless device such as a mobile phone needs to be adaptable to multi-bands for a plurality of applications, for example, the global system for mobile communications (GSM) and the digital cellular system (DCS), the personal digital cellular (PDC) and the personal handyphone system (PHS), and the like. In order to meet the demand, there are provided various antennas. In these cases, the signals of different frequency bands can be transmitted and received by using only a single antenna.

Such an antenna, however, has many problems in handling multi-bands. Particularly, in required multiple frequency bands, in a region closer to the high-frequency side, the frequency bandwidth tends to be narrower. As a result, it is difficult to obtain bandwidths allocated to the applications. In addition, it is extremely difficult to control the frequency bandwidths independently from each other. These are critical problems to be solved.

SUMMARY OF THE INVENTION

In view of the foregoing problems, it is an object of the present invention to provide a multi-band surface-mounted antenna. The signals of different frequency bands can be transmitted and received by the single antenna. Additionally, the broadening of frequency bands can be easily made, and particularly, the frequency bandwidths can be controlled independently from each other. Furthermore, it is another object of the invention to provide a wireless device incorporating the multi-band surface-mounted antenna.

In order to accomplish the above objects, according to a first aspect of the present invention, there is provided a surface-mounted antenna including a dielectric base member, a feeding element formed by extending a radiation electrode from a feeding terminal on the dielectric base member, and a non-feeding element formed by extending a radiation electrode from a ground terminal on the dielectric base member. In this arrangement, the feeding element and the non-feeding element are arranged via a distance therebetween. In addition, at least one of the feeding element and the non-feeding element is a branched element formed by extending a plurality of radiation electrodes branched from the feeding-terminal side or the ground-terminal side via a distance therebetween.

In this surface-mounted antenna, the plurality of radiation electrodes forming the branched element may have different fundamental-wave resonance frequencies.

In addition, in the surface-mounted antenna, the plurality of radiation electrodes forming the branched element may be extended from one of the feeding-terminal side and the ground-terminal side in directions in which the distance between the radiation electrodes is expanded.

Furthermore, in the surface-mounted antenna, at least one of the plurality of radiation electrodes forming the feeding element and the non-feeding element may locally include at least one of a fundamental-wave controlling unit for controlling a fundamental-wave resonance frequency and a harmonic controlling unit for controlling a harmonic resonance frequency.

In this surface-mounted antenna, the fundamental wave controlling unit may be locally disposed in a fundamental-wave maximum resonance current region including a maximum current portion at which a fundamental-wave resonance current reaches a maximum on a current path of the radiation electrode. In addition, the harmonic controlling unit may be locally disposed in a harmonic maximum resonance current region including a maximum current portion at which a harmonic resonance current reaches a maximum on the current path of the radiation electrode.

In addition, on the feeding element, there may be alternately arranged a region of a small current length per unit length and a region of a large current length per unit length along the current path.

In addition, in the surface-mounted antenna, at least one of the branched radiation electrodes of one of the feeding element and the non-feeding element may perform combined resonance with a radiation electrode of the remaining element.

In addition, in the surface-mounted antenna, electric power may be supplied to the feeding terminal of the feeding element by capacitive coupling.

According to a second aspect of the present invention, there is provided a wireless device including the surface-mounted antenna described above.

In this specification, of the plurality of resonance waves of the radiation electrodes, the resonance wave having the lowest resonance frequency is defined as the fundamental wave, and the resonance waves having resonance frequencies higher than that of the fundamental wave are defined as the harmonics. In addition, a state in which there are two or more resonance points within one frequency band is defined as combined resonance.

In the above structure, at least the three radiation electrodes are formed on a surface of the dielectric base member so that the antenna is easily adaptable to multi-bands. Moreover, by setting the current-vector directions of the radiation electrodes and the distances between the radiation electrodes according to needs, the resonance waves of the radiation electrodes can be controlled independently from each other. Thus, for example, only one frequency band of required frequency bands is selected to set in a multi-resonance state so that broadening of the used frequency band can be very easily achieved.

BRIEF DESCRIPTION OF THE DRAWING(S)

DETAILED DESCRIPTION OF EMBODIMENTS OF THE INVENTION

A description will be given of the embodiments of the present invention with reference to the drawings.

Figure 1:
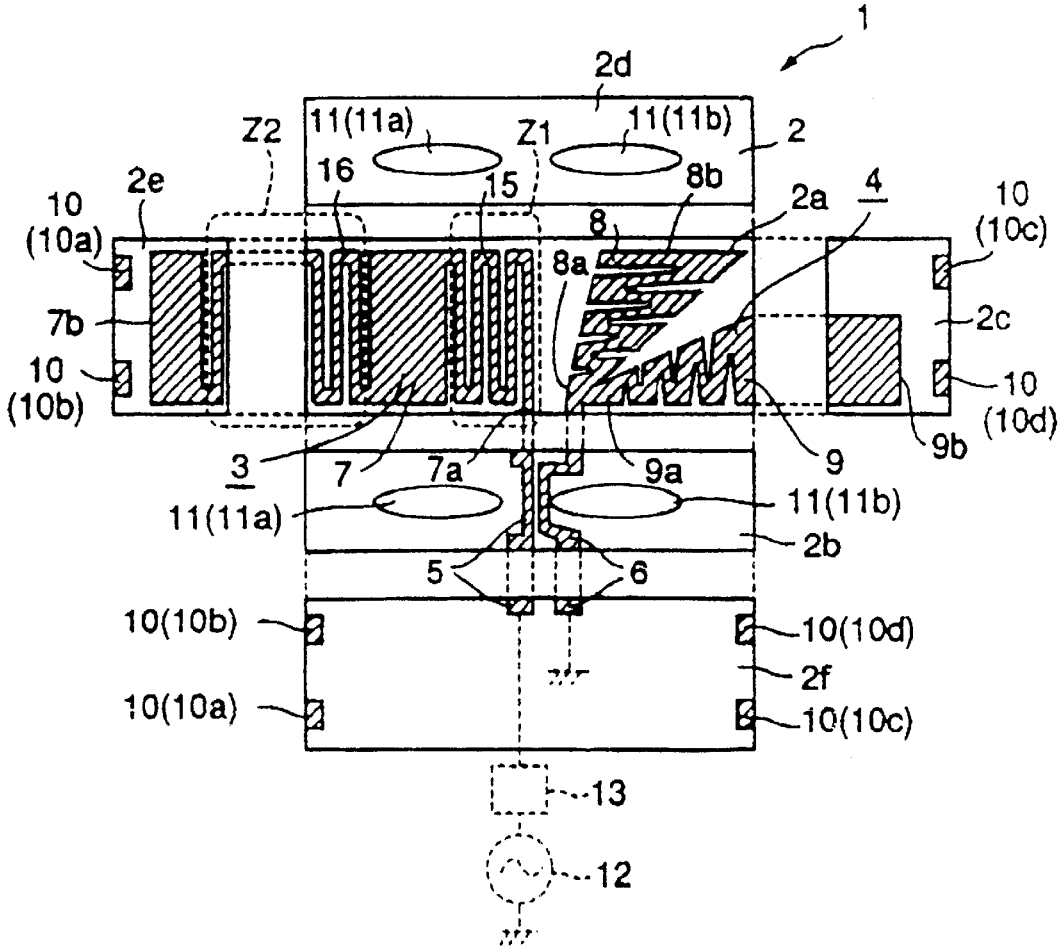
FIG. 1 is the illustration of a surface-mounted antenna according to a first embodiment of the present invention.

FIG. 1 shows a developed view of a surface-mounted antenna according to a first embodiment of the invention. In a surface-mounted antenna 1 shown in FIG. 1, on a rectangular-parallelepiped dielectric base member 2, a feeding element 3 and a non-feeding element 4 are arranged with a distance therebetween. Most uniquely, the non-feeding element 4 is formed as a branched element.

That is, as shown in FIG. 1, on a front side surface 2*b* of the dielectric base member 2, a feeding terminal 5 and a ground terminal 6, which are extended from a bottom surface 2*f* in an upper direction in the figure, are arranged with a distance therebetween. In addition, on an upper surface 2*a* of the dielectric base member 2, there is formed a radiation electrode 7 of the feeding side continued to the feeding terminal 5. The radiation electrode 7 of the feeding side is extended from the upper surface 2*a* to a left side surface 2*e* in the figure. A top end 7*b* of the extended radiation electrode 7 of the feeding side is open-circuited. On the upper surface 2*a* of the dielectric base member 2, in addition to the radiation electrode 7 of the feeding side, a first radiation electrode 8 and a second radiation electrode 9 of the non-feeding side having meandering shapes branched and extended from the ground terminal 6 are arranged with a distance between the electrodes 8 and 9.

In the first embodiment, the feeding element 3 is formed by the feeding terminal 5 and the feeding-side radiation electrode 7. The non-feeding element 4 is formed by the ground terminal 6 and the non-feeding-side first and second radiation electrodes 8 and 9. As mentioned above, the non-feeding element 4 is formed as a branched element.

The non-feeding-side first and second radiation electrodes 8 and 9, as shown in FIG. 1, are extended from the ground terminal 6 in directions in which the distance therebetween is expanded. With this arrangement, the mutual interference between the non-feeding-side first and second radiation electrodes 8 and 9 is prevented. A top end 8*b* of the extended non-feeding-side first radiation electrode 8 is open-circuited. In addition, the non-feeding-side second radiation electrode 9 is extended to a right side surface 2*c* from the upper surface 2*a* in the figure. A top end 9*b* of the extended non-feeding-side second radiation electrode 9 is open-circuited.

In the first embodiment, as shown in FIG. 1, in the feeding-side radiation electrode 7 and the non-feeding-side first radiation electrode 8 adjacent to each other separated by the distance, the directions of the current vectors of the electrodes 7 and 8 are substantially orthogonal to each other. With this arrangement, the mutual interference between the feeding-side radiation electrode 7 and the non-feeding-side first radiation electrode 8 is prevented. The directions of the current vectors of the feeding-side radiation electrode 7 and the non-feeding-side second radiation electrode 9 are almost the same. However, there is a large distance between the feeding-side radiation electrode 7 and the non-feeding-side second radiation electrode 9. In addition, the open-circuited ends of both radiation electrodes 7 and 9, where the electric fields are the largest, are oriented to mutually opposite directions and also, there is a large distance therebetween. Thus, there is substantially no mutual interference between the feeding-side radiation electrode 7 and the non-feeding-side second radiation electrode 9.

As shown in FIG. 1, on the left side surface 2*e* and the right side surface 2*c* of the dielectric base member 2, there are formed fixing electrodes 10 (10*a*, 10*b*, 10*c*, and 10*d*), which are extended down to the bottom surface 2*f*.

Furthermore, in the embodiment shown in FIG. 1, there are formed through-holes (11*a* and 11*b*) penetrating from the front side surface 2*b* of the dielectric base member 2 to a backside surface 2*d* thereof. With the through-holes 11, the weight of the dielectric base member 2 can be reduced. In addition, effective permeability between the ground and the radiation electrodes 7, 8, and 9 is reduced and electric-field concentration is lowered, with the result that a used frequency band can be broadened and a high gain can be obtained.

The surface-mounted antenna 1 shown in FIG. 1 is mounted on a circuit board of a wireless device such as a mobile phone. In this case, the bottom surface 2*f* with respect to the upper surface 2*a* of the dielectric base member 2 is used as a bottom surface when mounted.

Figure 8:
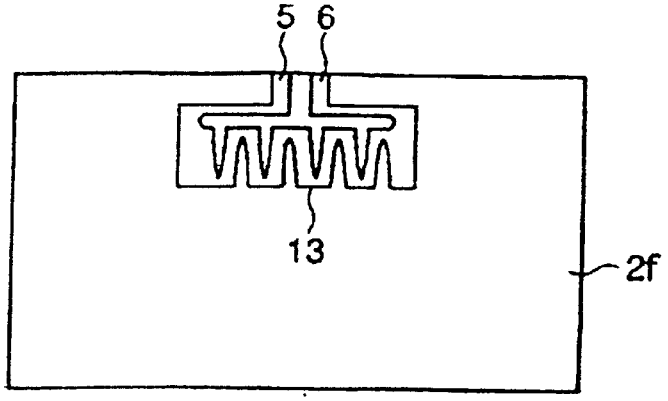
FIG. 8 is an illustration of an example in which an electrode pattern for a matching circuit is disposed on a surface of a dielectric base member forming a surface-mounted antenna.

For example, a signal supply source 12 and a matching circuit 13 are formed on the circuit board of the wireless device. By mounting the surface-mounted antenna 1 on the circuit board, the feeding terminal 5 of the surface-mounted antenna 1 is electrically connected to the signal supply source 12 via the matching circuit 13. The matching circuit 13 is incorporated in the circuit board of the wireless device. However, it is also possible to form the matching circuit 13 as a part of an electrode pattern on the dielectric base member 2. For example, when the matching circuit 13 for adding an inductance component L is disposed between the feeding terminal 5 and the ground terminal 6, as shown in FIG. 8, a meandering electrode pattern may be formed as the matching circuit 13 on the bottom surface 2*f* of the dielectric base member 2.

In the surface-mounted antenna 1 mounted as described above, when a signal is directly supplied to the feeding terminal 5 from the signal supply source 12 via the matching circuit 13, the signal is then supplied from the feeding terminal 5 to the feeding-side radiation electrode 7, and at the same time, by electromagnetic coupling, the signal is also supplied to the non-feeding-side first and second radiation electrodes 8 and 9. With the supply of the signal, in the feeding-side radiation electrode 7 and the non-feeding-side first and second radiation electrodes 8 and 9, currents flow from base ends 7*a*, 8*a*, and 9*a* of the electrodes 7, 8, and 9 to the open-circuited ends 7*b*, 8*b*, and 9*b* thereof. As a result, the feeding-side radiation electrode 7 and the non-feeding-side first and second radiation electrodes 8 and 9 resonate, by which signal transmission/reception is performed.

Figure 3:
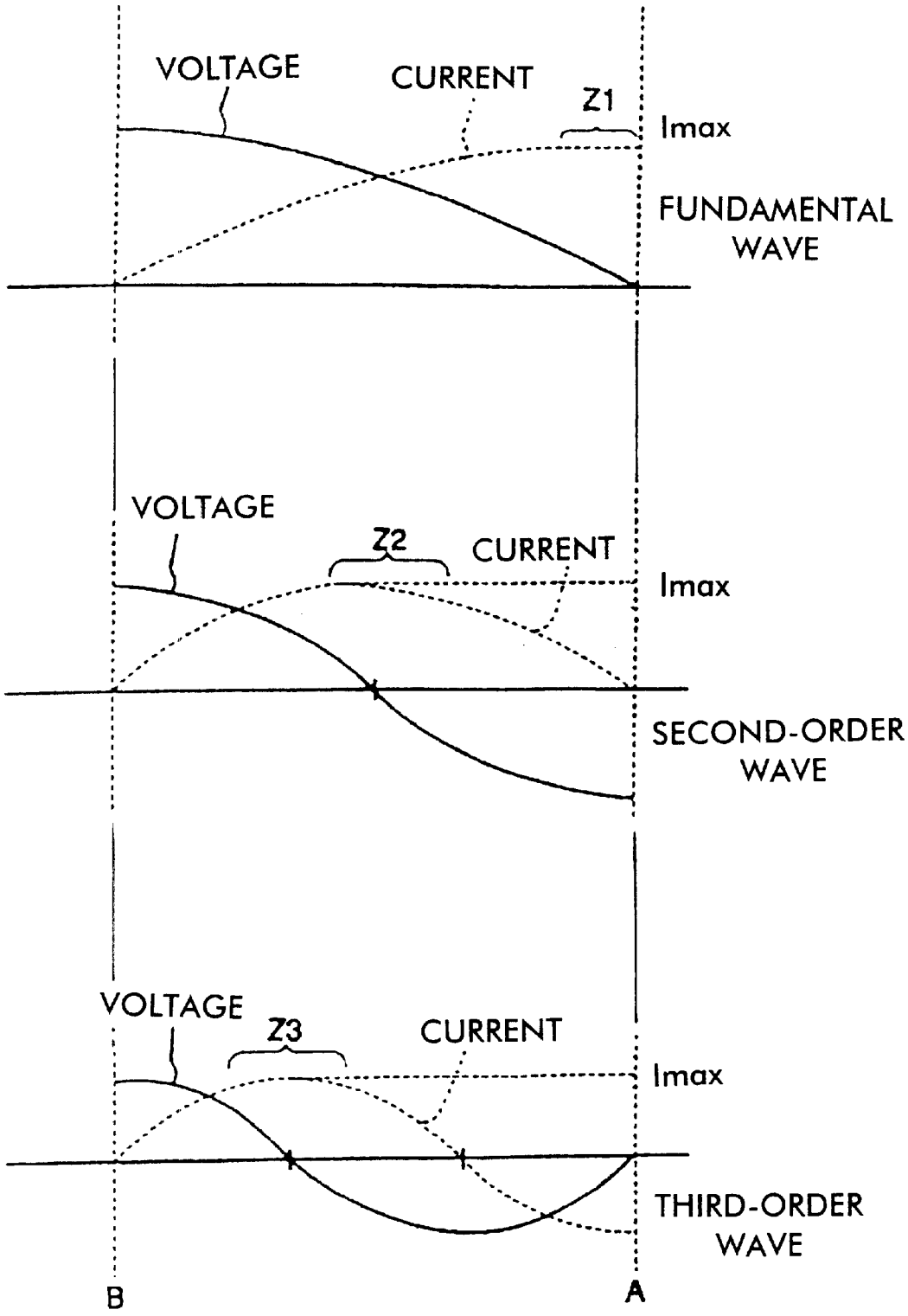
FIG. 3 is a graphical illustration of the typical current distributions and voltage distributions of resonance waves in a radiation electrode.

Meanwhile, in FIG. 3, there are shown the typical current distributions of one of the radiation electrodes indicated by dotted lines and typical voltage distributions thereof indicated by solid lines, regarding a fundamental wave, a second-order wave (harmonic), and a third-order wave (harmonic). In this figure, the end A corresponds to the signal supplying side of each of the radiation electrodes 7, 8, and 9, that is, the base-end sides 7*a*, 8*a*, and 9*a*. The end B corresponds to the open-circuited ends 7*b*, 8*b*, and 9*b* thereof.

As shown in FIG. 3, each resonance wave has a unique current distribution and a unique voltage distribution. For example, the maximum resonance current region of the fundamental wave, that is, a region Z1 including a maximum current portion Imax at which the fundamental-wave resonance current reaches a maximum, lies at each of the base ends 7*a*, 8*a*, and 9*a* of the radiation electrodes 7, 8, and 9. The maximum resonance current region of the second-order harmonic, that is, a region Z2 including a maximum current portion Imax at which the second-order-wave resonance current reaches a maximum, lies at each center of the radiation electrodes 7, 8, and 9. As shown here, the maximum resonance current regions of the resonance waves of the radiation electrodes 7, 8, and 9 are positioned in the mutually different points.

In the first embodiment, on the feeding-side radiation electrode 7, there are partially formed a meandering pattern 15 in the maximum resonance current region Z1 of the fundamental wave and a meandering pattern 16 in the maximum resonance current region Z2 of the second-order wave. With this arrangement, a series inductance component is locally added to each of the maximum resonance current region Z1 of the fundamental wave and the maximum resonance current region Z2 of the second-order wave on the feeding-side radiation electrode 7. In other words, by partially forming the meandering patterns 15 and 16, an electric length per unit length in each of the regions Z1 and Z2 is larger than that in the other region. In the feeding-side radiation electrode 7, the region having the large electric length per unit length and the region having the small electric length per unit length are alternately arranged in series along a current path.

A resonance frequency f1 of the fundamental wave can be controlled by changing the magnitude of the series inductance component composed of the meandering pattern 15 formed in the maximum resonance current region Z1 of the fundamental wave. In this case, there are very few influences whereby the resonance frequencies of the other resonance waves are changed. Similarly, a resonance frequency f2 of the second-order wave (harmonic) can be changed in a state independent from the other resonance waves by changing the magnitude of the series inductance component composed of the meandering pattern 16 formed in the maximum resonance current region Z2 of the second-order wave.

As mentioned above, the meandering pattern 15 can serve as the fundamental-wave controlling unit for controlling the resonance frequency f1 of the fundamental wave, and the meandering pattern 16 can serve as the harmonic controlling unit for controlling the resonance frequency f2 of the second-order wave as a harmonic. In order to change the magnitudes of the series inductance components formed by the meandering patterns 15 and 16, for example, the numbers of the meandering lines, the distance between the meandering lines, and the widths of the meandering lines, and the like may be changed. However, the explanation about these possible changes will be omitted.

By partially disposing the above-mentioned meandering patterns 15 and 16 on the feeding-side radiation electrode 7, it is possible to easily design the feeding-side radiation electrode 7 in order to set the resonance frequency f1 of the fundamental wave and the resonance frequency f2 of the second-order harmonic at desired frequencies. In addition, when the fundamental-wave resonance frequency and the second-order-wave resonance frequency of the formed feeding-side radiation electrode 7 deviate from the set frequencies due to insufficient forming precision, the meandering pattern 15 or 16 formed in the maximum resonance current region of a resonance wave having a frequency as a target for adjustment is trimmed to change the magnitude of the series inductance component. With this arrangement, the deviated frequency can coincide with the set frequency. In this case, as mentioned above, the frequencies of resonance waves except the resonance wave having the frequency as the target for adjustment hardly change. Thus, the resonance frequency can be simply and quickly adjusted.

The surface-mounted antenna 1 shown in the first embodiment is formed above. When the lengths of the current paths in the radiation electrodes 7, 8, and 9, the magnitudes of the series inductance components composed of the meandering patterns 15 and 16 formed on the feeding-side radiation electrode 7, and the like, are changed in various manners, the surface-mounted antenna 1 can have various return loss characteristics.

Figure 2A:
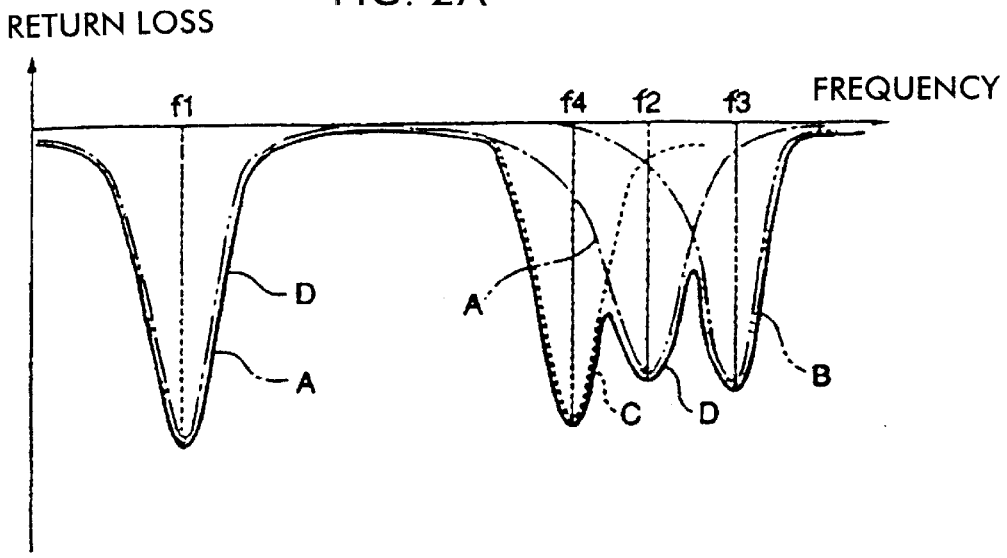
FIGS. 2A and 2B are the graphical illustrations of return loss characteristics obtainable by the surface-mounted antenna in accordance with the first embodiment.
Figure 2B:
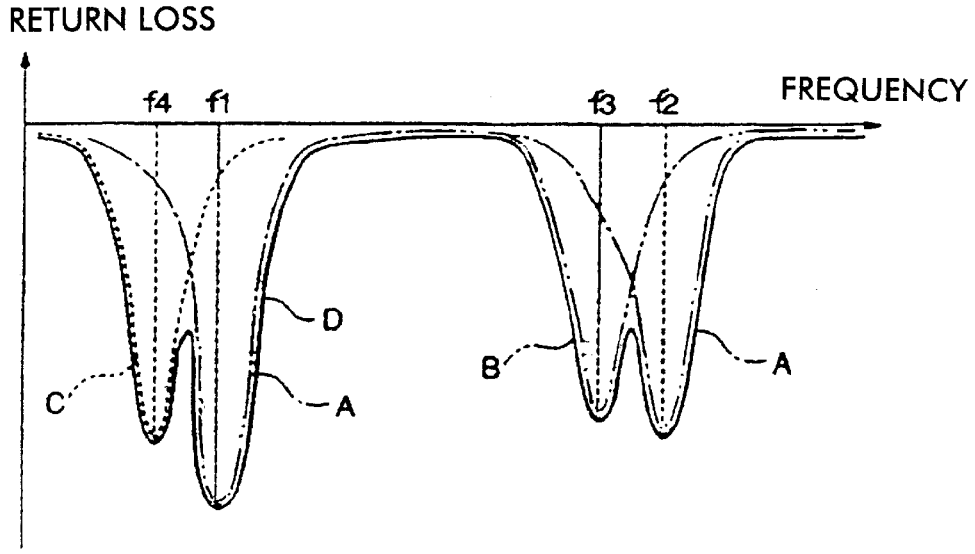

For example, when there is a demand for an antenna capable of transmitting and receiving the signals of two different frequency bands, the surface-mounted antenna 1 can have return loss characteristics as indicated by the solid lines D shown in FIGS. 2A and 2B. In these figures, the dash-single-dot lines A indicate the return loss characteristics of the feeding-side radiation electrode 7, and the dash-double-dot lines B indicate the return loss characteristics of the non-feeding-side first radiation electrode 8. The dotted lines C indicate the return loss characteristics of the non-feeding-side second radiation 9. In addition, the frequency f1 is the fundamental-wave resonance frequency of the feeding-side radiation electrode 7, and the frequency f2 is the second-order-wave resonance frequency of the feeding-side radiation electrode 7. The frequency f3 is the fundamental-wave resonance frequency of the non-feeding-side first radiation electrode 8, and the frequency f4 is the fundamental-wave resonance frequency of the non-feeding-side second radiation electrode 9.

In the above embodiment shown in FIG. 2A, the fundamental-wave resonance frequency f1 of the feeding-side radiation electrode 7 is set in such a manner that the low frequency band of the required two frequency bands can be obtained. The second-order-wave resonance frequency f2 of the feeding-side radiation electrode 7 is set in such a manner that the high frequency band thereof can be obtained. In addition, the fundamental-wave resonance frequency f3 of the non-feeding-side first radiation electrode 8 is set above the second-order-wave resonance frequency f2 of the feeding-side radiation electrode 7, and the fundamental-wave resonance frequency f4 of the non-feeding-side second radiation electrode 9 is set below the second-order-wave resonance frequency f2 of the feeding-side radiation electrode 7.

In this manner, the fundamental-wave resonance frequency f3 of the non-feeding-side first radiation electrode 8 and the fundamental-wave resonance frequency f4 of the non-feeding-side second radiation electrode 9 are set near the second-order-wave resonance frequency f2 of the feeding-side radiation electrode 7. Additionally, as mentioned above, in the first embodiment, the mutual interference between the radiation electrodes 7, 8, and 9 can be prevented. Therefore, without problems such as attenuation of the resonance waves, the fundamental waves of the non-feeding-side first and second radiation electrodes 8 and 9 perform combined resonance (overlapping), and as shown in FIG. 2A, the frequency band of the high-frequency side can be broadened.

In addition, in the embodiment shown in FIG. 2B, the resonance frequency f1 of the fundamental wave and the resonance frequency f2 of the second-order-wave of the feeding-side radiation electrode 7 are set in the same manner as those shown in FIG. 2A. That is, the resonance frequency f4 of the fundamental wave of the non-feeding-side second radiation electrode 9 is set near the resonance frequency f1 of the fundamental wave of the feeding-side radiation electrode 7, and the fundamental wave of the non-feeding-side second radiation electrode 9 performs combined resonance with the fundamental wave of the feeding-side radiation electrode 7. In addition, the resonance frequency f3 of the fundamental wave of the non-feeding-side first radiation electrode 8 is set near the resonance frequency f2 of the second-order harmonic of the feeding-side radiation electrode 7, and the fundamental wave of the non-feeding-side first radiation electrode 8 performs combined resonance with the second-order harmonic of the feeding-side radiation electrode 7. As shown here, in the embodiment shown in FIG. 2B, the frequency bands of both of the low and high frequency sides are in the multi-resonance states so that broadening of the used frequency band can be achieved.

In this case, the return loss characteristics shown in FIGS. 2A and 2B are used to instantiate return loss characteristics obtainable by the surface-mounted antenna 1 according to the first embodiment. However, by designing the radiation electrodes 7, 8, and 9 according to necessity, return loss characteristics unlike those shown in the FIGS. 2A and 2B can be obtained. The explanation thereof will be omitted.

In the first embodiment, the non-feeding element 4 is formed as a branched element composed of the two radiation electrodes 8 and 9. As a result, the single surface-mounted antenna 1 includes three radiation electrodes 7, 8, and 9, by which the surface-mounted antenna 1 can be easily adapted to multi-bands. Particularly, in the first embodiment, the non-feeding-side first and second radiation electrodes 8 and 9 are extended in the directions in which the distance between the electrodes 8 and 9 is expanded from the base ends 8*a* and 9*a* thereof. Thus, the mutual interference between the non-feeding-side first and second radiation electrodes 8 and 9 can be prevented. In addition, each of the resonance waves of the non-feeding-side first and second radiation electrodes 8 and 9 can be controlled in a state substantially independent from the other. With this arrangement, the multi-band adaptability of the antenna 1 can be further enhanced.

Furthermore, in the first embodiment, the meandering pattern 15 as the fundamental-wave controlling unit and the meandering pattern 16 as the harmonic controlling unit are disposed on the feeding-side radiation electrode 7. With this arrangement, designing of the feeding-side radiation electrode 7 can be simplified to complete it in a short time. In addition, the resonance frequency f1 of the fundamental wave and the resonance frequency f2 of the harmonic can be easily adjusted, with the result that the surface-mounted antenna 1 can have highly reliable antenna characteristics.

In addition, the resonance waves of the non-feeding-side first and second radiation electrodes 8 and 9 can simply perform multi-resonance with the fundamental wave and the harmonic of the feeding-side radiation electrode 7. Thus, with the combined resonance, the used frequency band can be broadened. Furthermore, as mentioned above, by broadening the frequency band by combining the resonance wave of the feeding-side radiation electrode 7 with the resonance waves of the non-feeding-side radiation electrodes 8 and 9, only the frequency band selected from the plurality of required frequency bands can be broadened in a state independent from the other frequency band. Thus, the multi-band surface-mounted antenna 1 can be designed easily.

Now, a description will be given of a second embodiment of the present invention. In the explanation of the second embodiment below, the same reference numerals as those used in the first embodiment are given to the same structural parts, and the explanation thereof is omitted.

Figure 4:
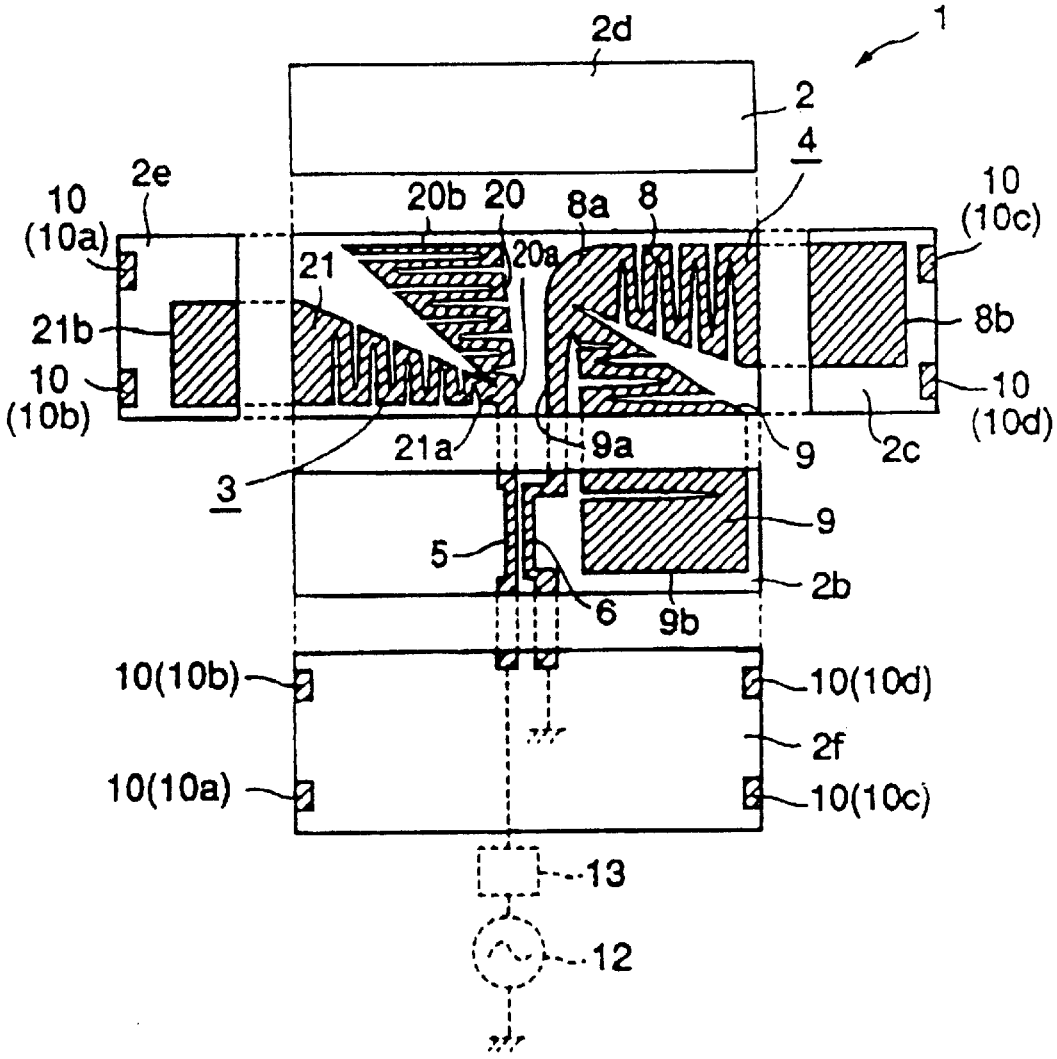
FIG. 4 is the illustration of a surface-mounted antenna according to a second embodiment of the invention.

FIG. 4 shows a developed view of a surface-mounted antenna according to the second embodiment of the invention. A surface-mounted antenna 1 shown in the second embodiment has a structure different from that of the first embodiment. Significantly, in the second embodiment, both a non-feeding element 4 and a feeding element 3 are branched elements.

Specifically, as shown in FIG. 4, on an upper surface 2*a* of a dielectric base member 2, feeding-side first and second radiation electrodes 20 and 21 are branched from a feeding terminal 5 formed on a front side surface 2*b* and are extended with a distance therebetween. In this second embodiment, the feeding element 3 is constituted of the feeding terminal 5 and the feeding-side first and second radiation electrodes 20 and 21.

The feeding-side first and second radiation electrodes 20 and 21 are extended in a direction in which the distance between the electrodes 20 and 21 is expanded from the feeding terminal 5. As a result, the mutual interference between the feeding-side first and second radiation electrodes 20 and 21 can be prevented. A top end 20*b* of the feeding-side first radiation electrode 20 is open-circuited. The feeding-side second radiation electrode 21 is further extended from the upper surface 2*a* to a left side surface 2*e*, and a top end 21*b* of the extended electrode 21 is open-circuited.

In addition, as shown in FIG. 4, from a ground terminal 6 of the non-feeding element 4, non-feeding-side first and second radiation electrodes 8 and 9 are branched to have a distance therebetween, and are extended in directions in which the distance between the electrodes 8 and 9 is expanded. The non-feeding-side first radiation electrode 8 is extended from the upper surface 2*a* of the dielectric base member 2 to a right side surface 2*c*. The second radiation electrode 9 is extended from the upper surface 2*a* thereof to the front side surface 2*b*. A top end 8*b* of the non-feeding-side first radiation electrode 8 and a top end 9*b* of the second radiation electrode 9 are open-circuited.

The surface-mounted antenna 1 in accordance with the second embodiment has the above structure. As in the case of the first embodiment, by designing the radiation electrodes 8, 9, 20, and 21 according to needs, the surface-mounted antenna can have various return loss characteristics.

Figure 5A:
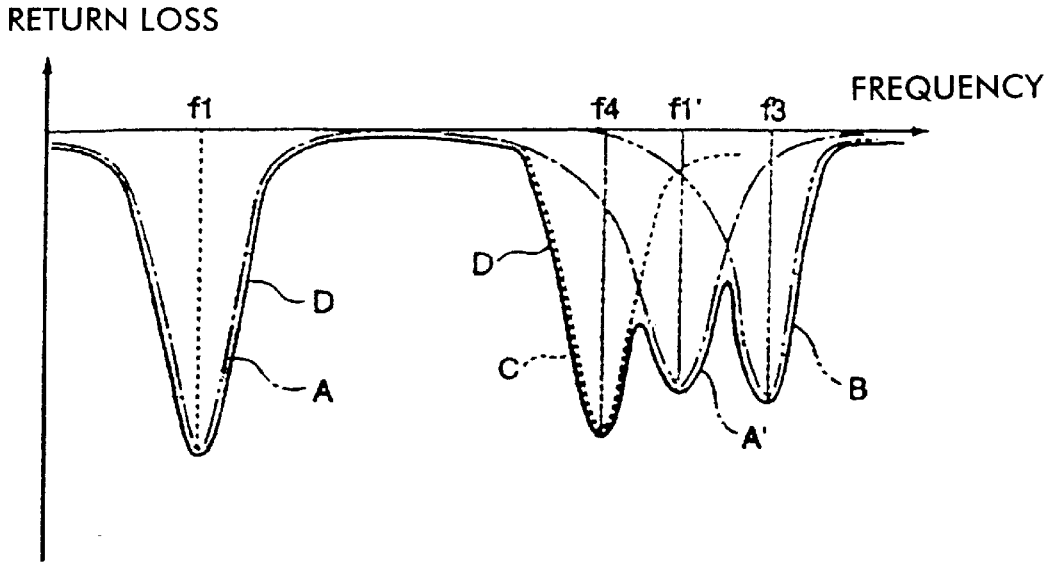
FIGS. 5A and 5B are the graphical illustration of return loss characteristics obtainable by the surface-mounted antenna in accordance with the second embodiment.
Figure 5B:
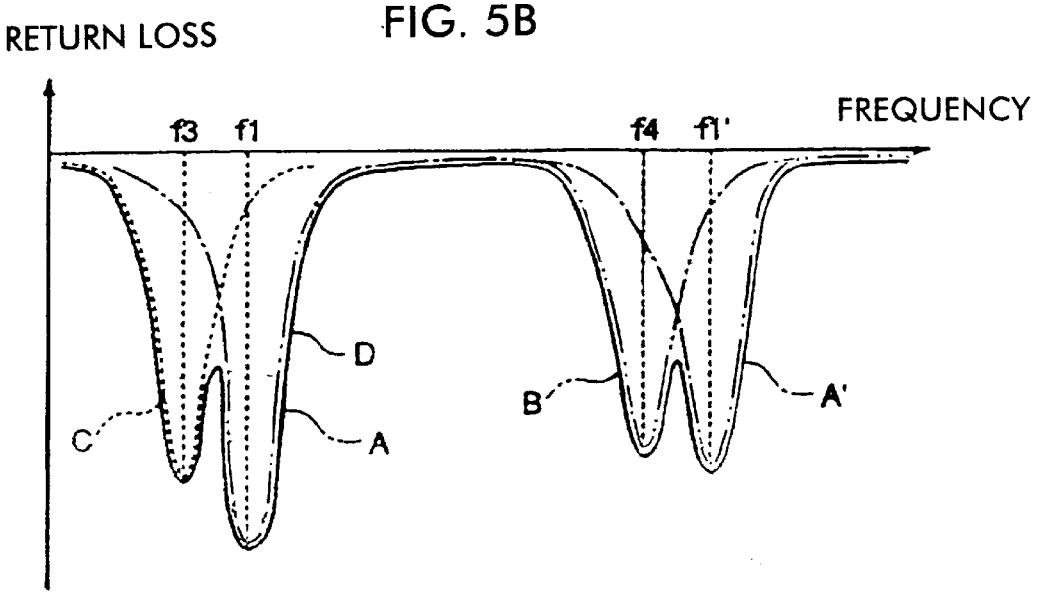

For example, the surface-mounted antenna 1 can have return loss characteristics as indicated by solid lines D in FIGS. 5A and 5B. In these figures, dash-single-dot lines A indicate the return loss characteristics of the feeding-side first radiation electrode 20, and dash-single-dot lines A' indicate the return loss characteristics of the feeding-side second radiation electrode 21. Dash-double-dot lines B indicate the return loss characteristics of the non-feeding-side first radiation electrode 8. Dotted lines C indicate the return loss characteristics of the non-feeding-side second radiation electrode 9. In addition, a frequency f1 indicates the resonance frequency of the fundamental wave of the feeding-side first radiation electrode 20. A frequency f1' indicates the resonance frequency of the fundamental wave of the feeding-side second radiation electrode 21. A frequency f3 indicates the resonance frequency of the fundamental wave of the non-feeding-side first radiation electrode 8. A frequency f4 indicates the resonance frequency of the fundamental wave of the non-feeding-side second radiation electrode 9.

In the example shown in FIG. 5A, in the frequency band on the high frequency side of two required frequency bands, by bringing about a multi-resonance state with the feeding-side second radiation electrode 21 and the non-feeding-side first and second radiation electrodes 8 and 9, the used frequency band is broadened. In addition. in the example shown in FIG. 5B, both of the two required frequency bands are in the multi-resonance states so that broadening of the frequency band can be achieved.

Certainly, by designing the radiation electrodes 8, 9, 20, and 21 according to needs, the surface-mounted antenna 1 shown in the second embodiment can have return loss characteristics other than the return loss characteristics shown in FIGS. 5A and 5B. However, the explanation thereof will be omitted here.

In the second embodiment, since both of the feeding element 3 and the non-feeding element 4 are branched elements, the antenna 1 is more adaptable to multi-bands. In addition, the resonance waves of the radiation electrodes 8, 9, 20, and 21 can be controlled in states independent from each other. This arrangement can increase the freedom of designing of the multi-band surface-mounted antenna 1. Moreover, there are advantages in which multi-resonance states can easily be brought about, thereby easily broadening a used frequency band, and only a frequency band selected from a plurality of required frequency bands can be broadened.

Figure 6:
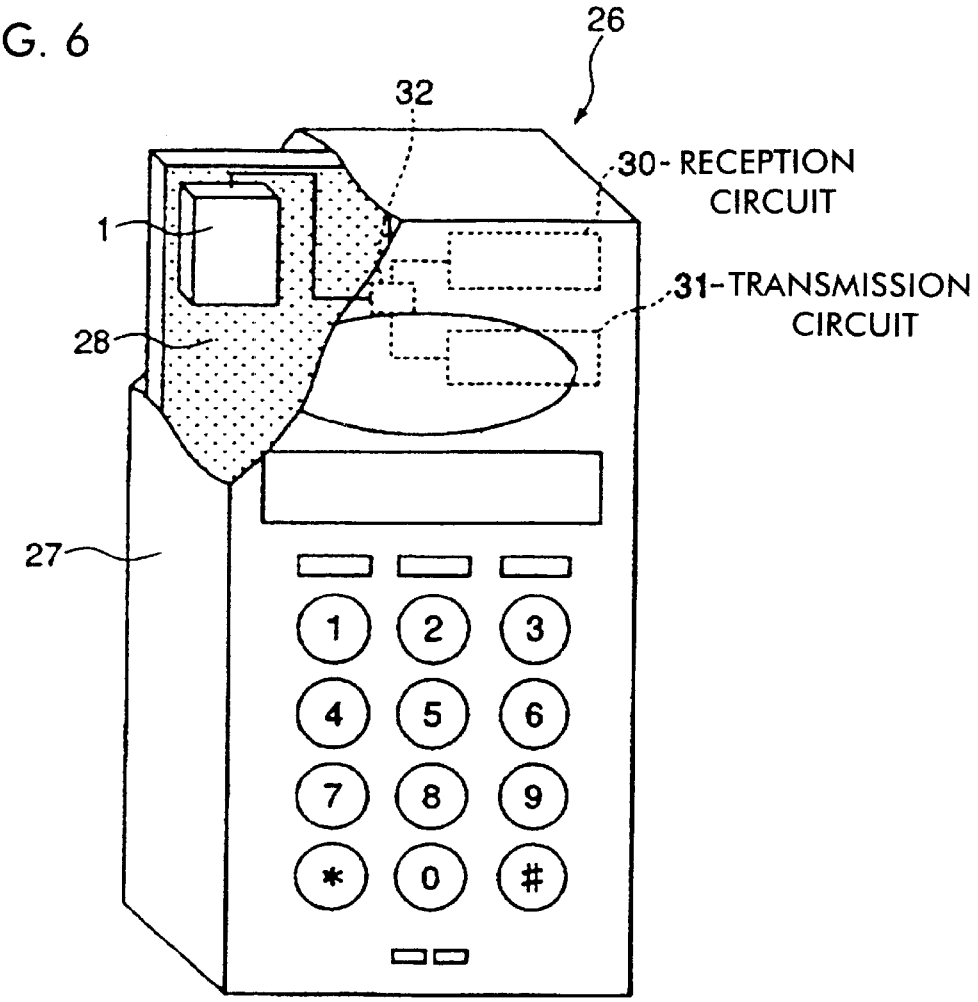
FIG. 6 is a model view for illustrating a wireless device according to a third embodiment of the invention.

Next, a description will be given of a third embodiment of the invention. In the third embodiment, there will be shown an illustration of a wireless device. The wireless device according to the third embodiment, as shown in FIG. 6, is a portable wireless device 26. A circuit board 28 is contained in a case 27 thereof. On the circuit board 28, there is mounted a surface-mounted antenna 1 having the unique structure shown in each of the above embodiments.

On the circuit board 28 of the portable wireless device 26, as shown in FIG. 6, as signal supply sources, there are formed a transmission circuit 30, a reception circuit 31, and a transmission/reception switching circuit 32. The surface-mounted antenna 1 is mounted on the circuit board 28, by which the antenna 1 is electrically connected to the transmission circuit 30 and the reception circuit 31 via the transmission/reception switching circuit 32. In the portable wireless device 26, by switching the transmission/reception switching circuit 32, transmission/reception can be smoothly performed.

According to the third embodiment, the surface-mounted antenna having the unique structure shown in each of the above embodiments is incorporated in the portable wireless device 26. Thus, with only the single surface-mounted antenna 1 incorporated, the signals of different frequency bands can be transmitted and received. As a result, it is unnecessary to incorporate multiple antennas according to the number of frequency bands required to transmit and receive signals of the different frequency bands, thereby contributing to further miniaturization of the portable wireless device 26. In addition, the wireless device can also have highly reliable antenna characteristics.

However, the present invention is not restricted to the above-described embodiments, and various modifications can be made. For example, in the first embodiment, of the feeding element 3 and the non-feeding element 4, only the non-feeding element 4 is formed as a branched element. In the second embodiment, both the feeding element 3 and the non-feeding element 4 are formed as branched elements. However, of the feeding element 3 and the non-feeding element 4, only the feeding element 3 may be formed as a branched element. In this case, also, there can be obtained the same advantages as those obtained in the above embodiments.

Figure 7:
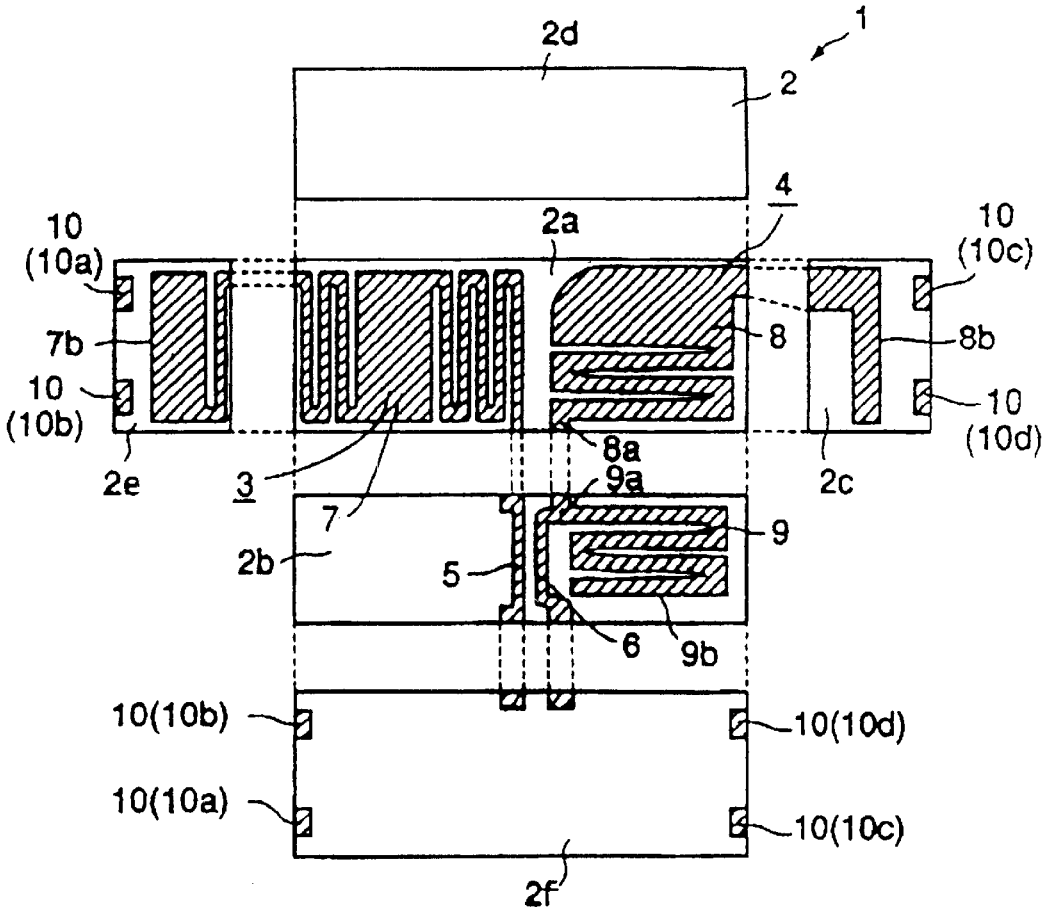
FIG. 7 is an illustration of a surface-mounted antenna according to another embodiment of the invention.

In addition, the configurations of the feeding element 3 and the non-feeding element 4 are not restricted to those shown in the embodiments described above, and various changes can be made. For example, in FIG. 7, there is shown another example of the configuration of the non-feeding element 4. In a surface-mounted antenna 1 shown in FIG. 7, except for the non-feeding element 4, the other structural parts of the antenna 1 are the same as those used in the surface-mounted antenna 1 shown in FIG. 1. In FIG. 7, the same structural parts as those of the surface-mounted antenna 1 shown in FIG. 1 are indicated by the same reference numerals.

In the non-feeding element 4 shown in FIG. 7, a non-feeding-side first radiation electrode 8 is extended from a ground terminal 6 to a right side surface 2*c* via an upper surface 2*a* of a dielectric base member 2. A non-feeding-side second radiation electrode 9 is extended from the ground terminal 6 to a front side surface 2*b* of the dielectric base member 2. As shown here, the non-feeding-side first and second radiation electrodes 8 and 9 may be disposed on different surfaces of the dielectric base member 2.

Furthermore, in the embodiments described above, the feeding element 3 and the non-feeding element 4 are branched elements composed of radiation electrodes formed by branching into two parts. However, the number of radiation electrodes forming each of branched elements may be three or more.

In addition, in the first embodiment, the meandering pattern 15 as the fundamental-wave controlling unit is formed in the maximum resonance current region Z1 of the fundamental wave on the feeding-side radiation electrode 7, and the meandering pattern 16 as the harmonic controlling unit is formed in the maximum resonance current region Z2 of the second-order wave thereof. However, there may be provided a fundamental-wave-controlling unit and a harmonic-controlling unit having structures different from those of the meandering patterns 15 and 16. For example, regarding the fundamental-wave controlling unit, a series inductance component may be locally added to the maximum resonance current region Z1 of the fundamental wave, and regarding the harmonic controlling unit, a series inductance component may be locally added to the maximum resonance current region Z2 of the second-order harmonic, by which an electric length per unit length in each of the regions Z1 and Z2 can be increased. In addition, for example, by disposing parallel capacitances in the regions Z1 and Z2 on the current paths of the radiation electrodes, there may be disposed units for locally adding equivalent series inductance components as a fundamental-wave controlling unit and a harmonic controlling unit. Or, alternatively, in parts where the regions Z1 and Z2 are positioned on the dielectric base member 2, there may be locally disposed dielectric members having permeabilities larger than in the other regions as a fundamental-wave controlling unit and a harmonic controlling unit.

In addition, in the first embodiment, on the feeding-side radiation electrode 7, both of the fundamental-wave-controlling unit and the harmonic controlling unit are provided. However, only one of the controlling units may be provided.

In addition, in the second embodiment, the feeding element 3 is formed as a branched element having two radiation electrodes 20 and 21. Neither of the radiation electrode 20 nor the radiation electrode 21 has the fundamental-wave-controlling unit and the harmonic controlling unit as shown in the first embodiment. However, one or both of the two radiation electrodes 20 and 21 may have at least one of the fundamental-wave-controlling unit and the harmonic controlling unit as shown above. Furthermore, similarly, regarding the radiation electrodes 8 and 9 forming the non-feeding element 4, one or both of the radiation electrodes 8 and 9 may have at least one of the fundamental-wave-controlling unit and the harmonic controlling unit. Thus, one or more of the plurality of radiation electrodes forming the feeding element 3 and the non-feeding element 4 may have at least one of the fundamental-wave controlling unit and the harmonic-controlling unit disposed thereon.

In addition, in the surface-mounted antenna 1 illustrated in each of the embodiments described above, electrical power is directly supplied to the feeding terminal 5 from a signal supply source 12. However, the present invention can also be applied to a surface-mounted antenna 1 of a capacitance feeding type, in which electrical power is supplied to the feeding terminal 5 by capacitive coupling.

Furthermore, in the third embodiment, although a portable wireless device has been described as the example, the present invention can also be applied to an installed-type wireless device.

According to the invention, since one or both of the feeding element and the non-feeding element are formed as branched elements, at least three or more radiation electrodes are formed in the single surface-mounted antenna. Thus, for example, by making the fundamental-wave resonant frequencies of the plurality of radiation electrodes forming the branched elements different therebetween, the antenna is easily adaptable to multi-bands.

The plurality of radiation electrodes forming the branched elements is extended from the feeding terminal and the ground terminal in the directions in which the distance between the radiation electrodes is expanded. As a result, the mutual interference between the plurality of radiation electrodes forming the branched elements can be prevented. In addition since the resonance waves of the radiation electrodes can be controlled independently from each other, the radiation electrodes can be easily designed and the freedom of designing can be increased. Moreover, reliability of the antenna characteristics can be increased.

When at least one of the plurality of radiation electrodes forming the feeding element and the non-feeding element has one or both of the fundamental-wave controlling unit and the harmonic controlling unit formed thereon, with the radiation electrode having the fundamental-wave controlling unit and the harmonic controlling unit, the resonant frequencies of the fundamental wave and the harmonic can be controlled. Particularly, when the fundamental-wave controlling unit is locally disposed in the maximum resonance current region of the fundamental wave on the current path of the radiation electrode, and the harmonic controlling unit is locally disposed in the maximum resonance current region of the harmonic on the current path of the radiation electrode, the frequency of the resonance wave of one of the fundamental wave and the harmonic can be controlled in a state substantially independent from the other resonance wave. With this arrangement, the surfacemounted antenna can be designed very easily and quickly.

When the feeding element has a region of a large electrical length per unit length and a region of a small electrical length per unit length, which are alternately disposed in series, the difference between the resonant frequencies of the fundamental wave and the harmonic can be significantly changed and controlled. Particularly, the difference between the resonant frequencies thereof can be controlled with high precision, when the series inductance component is locally added to the maximum resonance current region of at least one of the fundamental wave and the harmonic in the feeding element of the surface-mounted antenna to form the region of a large electrical length.

When at least one of the pluralities of radiation electrodes branched in one of the feeding element and the non-feeding element performs multi-resonance with the radiation electrode of the other element, the frequency band can be easily broadened. In addition, broadening of the frequency band can be achieved by bringing only the frequency band selected from the plurality of required frequency bands into a multi-resonance state.

Similarly, the capacitive-feeding-type surface-mounted antenna can provide the same advantages as described above in terms of easy adaptability to multi-bands.

In the wireless device incorporating the surface-mounted antenna having the unique structure in accordance with the present invention as described above, with only the single surface-mounted antenna provided, the wireless device is easily adaptable to multi-bands. In addition, since it is unnecessary to dispose antennas according to the number of a plurality of required frequency bands, further miniaturization of the device can be enhanced. Moreover, the wireless device of the invention can have highly reliable antenna characteristics.

While the invention has been described in its preferred embodiments, it is to be understood that modifications and changes may be made without departing from the spirit and scope of the invention determined by the appended claims.

What is claimed is:

1. A surface-mounted antenna comprising:

a dielectric base member;

a feeding element formed by extending a radiation electrode from a feeding terminal on the dielectric base member; and a non-feeding element formed by extending a radiation electrode from a ground terminal on the dielectric base member, the feeding element and the non-feeding element being arranged with a distance therebetween;

wherein at least one of the feeding element and the non-feeding element comprises a branched element formed by extending a plurality of radiation electrodes branched from at least one of the feeding terminal and the ground terminal with a distance therebetween.

2. The surface-mounted antenna of claim 1, wherein the plurality of radiation electrodes forming the branched element is extended from the at least one of the feeding terminal and the ground terminal in directions in which the distance between the radiation electrodes is expanded.

3. The surface-mounted antenna of claim 2, wherein at least one of the plurality of radiation electrodes forming the feeding element and the non-feeding element locally includes at least one of a fundamental-wave controlling unit for controlling a fundamental-wave resonance frequency and a harmonic controlling unit for controlling a harmonic resonance frequency.

4. The surface-mounted antenna of claim 3, wherein the fundamental-wave controlling unit is locally disposed in a fundamental-wave maximum resonance current region including a maximum current portion at which a fundamental-wave resonance current reaches a maximum on a current path of the radiation electrode, and the harmonic controlling unit is locally disposed in a harmonic maximum resonance current region including a maximum current portion at which a harmonic resonance current reaches a maximum on the current path of the radiation electrode.

5. The surface-mounted antenna of claim 2, wherein the feeding element includes a region of a small electric length per unit length and a region of a large electric length per unit length, these regions being alternately arranged in series along the current path.

6. The surface-mounted antenna of claim 2, wherein at least one of the branched radiation electrodes of one of the feeding element and the non-feeding element performs combined resonance with a radiation electrode of the remaining element.

7. The surface-mounted antenna of claim 2, wherein electric power is supplied to the feeding terminal of the feeding element by capacitive coupling.

8. The surface-mounted antenna of claim 1, wherein at least one of the plurality of radiation electrodes forming the feeding element and the non-feeding element locally includes at least one of a fundamental-wave controlling unit for controlling a fundamental-wave resonance frequency and a harmonic controlling unit for controlling a harmonic resonance frequency.

9. The surface-mounted antenna of claim 8, wherein the fundamental-wave controlling unit is locally disposed in a fundamental-wave maximum resonance current region including a maximum current portion at which a fundamental-wave resonance current reaches a maximum on a current path of the radiation electrode, and the harmonic controlling unit is locally disposed in a harmonic maximum resonance current region including a maximum current portion at which a harmonic resonance current reaches a maximum on the current path of the radiation electrode.

10. The surface-mounted antenna of claim 9, wherein the feeding element includes a region of a small electric length per unit length and a region of a large electric length per unit length, these regions being alternately arranged in series along the current path.

11. The surface-mounted antenna of claim 9, wherein at least one of the branched radiation electrodes of one of the feeding element and the non-feeding element performs combined resonance with a radiation electrode of the remaining element.

12. The surface-mounted antenna of claim 9, wherein electric power is supplied to the feeding terminal of the feeding element by capacitive coupling.

13. The surface-mounted antenna of claim 8, wherein the feeding element includes a region of a small electric length per unit length and a region of a large electric length per unit length, these regions being alternately arranged in series along the current path.

14. The surface-mounted antenna of claim 8, wherein at least one of the branched radiation electrodes of one of the feeding element and the non-feeding element performs combined resonance with a radiation electrode of the remaining element.

15. The surface-mounted antenna of claim 8, wherein electric power is supplied to the feeding terminal of the feeding element by capacitive coupling.

16. The surface-mounted antenna of claim 1, wherein the feeding element includes a region of a small electric length per unit length and a region of a large electric length per unit length, these regions being alternately arranged in series along the current path.

17. The surface-mounted antenna of claim 16, wherein at least one of the branched radiation electrodes of one of the feeding element and the non-feeding element performs combined resonance with a radiation electrode of the remaining element.

18. The surface-mounted antenna of claim 16, wherein electric power is supplied to the feeding terminal of the feeding element by capacitive coupling.

19. The surface-mounted antenna of claim 1, wherein at least one of the branched radiation electrodes of one of the feeding element and the non-feeding element performs combined resonance with a radiation electrode of the remaining element.

20. The surface-mounted antenna of claim 19, wherein electric power is supplied to the feeding terminal of the feeding element by capacitive coupling.

21. The surface-mounted antenna of claim 1, wherein electric power is supplied to the feeding terminal of the feeding element by capacitive coupling.

22. A surface-mounted antenna comprising:

a dielectric base member;

a feeding element formed by extending a radiation electrode from a feeding terminal on the dielectric base member; and a non-feeding element formed by extending a radiation electrode from a ground terminal on the dielectric base member, the feeding element and the non-feeding element being arranged with a distance therebetween;

wherein at least one of the feeding element and the non-feeding element comprises a branched element formed by extending a plurality of radiation electrodes branched from at least one of the feeding terminal and the ground terminal with a distance therebetween; and wherein the plurality of radiation electrodes forming the branched element has different fundamental wave resonance frequencies.

23. The surface-mounted antenna of claim 22, wherein the plurality of radiation electrodes forming the branched element is extended from the at least one of the feeding terminal and the ground terminal in directions in which the distance between the radiation electrodes is expanded.

24. The surface-mounted antenna of claim 23, wherein at least one of the plurality of radiation electrodes forming the feeding element and the non-feeding element locally includes at least one of a fundamental-wave controlling unit for controlling a fundamental-wave resonance frequency and a harmonic controlling unit for controlling a harmonic resonance frequency.

25. The surface-mounted antenna of claim 24, wherein the fundamental-wave controlling unit is locally disposed in a fundamental-wave maximum resonance current region including a maximum current portion at which a fundamental-wave resonance current reaches a maximum on a current path of the radiation electrode, and the harmonic controlling unit is locally disposed in a harmonic maximum resonance current region including a maximum current portion at which a harmonic resonance current reaches a maximum on the current path of the radiation electrode.

26. The surface-mounted antenna of claim 22, wherein at least one of the plurality of radiation electrodes forming the feeding element and the non-feeding element locally includes at least one of a fundamental-wave controlling unit for controlling a fundamental-wave resonance frequency and a harmonic controlling unit for controlling a harmonic resonance frequency.

27. The surface-mounted antenna of claim 26, wherein the fundamental-wave controlling unit is locally disposed in a fundamental-wave maximum resonance current region including a maximum current portion at which a fundamental-wave resonance current reaches a maximum on a current path of the radiation electrode, and the harmonic controlling unit is locally disposed in a harmonic maximum resonance current region including a maximum current portion at which a harmonic resonance current reaches a maximum on the current path of the radiation electrode.

28. The surface-mounted antenna of claim 22, wherein the feeding element includes a region of a small electric length per unit length and a region of a large electric length per unit length, these regions being alternately arranged in series along the current path.

29. The surface-mounted antenna of claim 22, wherein at least one of the branched radiation electrodes of one of the feeding element and the non-feeding element performs combined resonance with a radiation electrode of the remaining element.

30. The surface-mounted antenna of claim 22, wherein electric power is supplied to the feeding terminal of the feeding element by capacitive coupling.

31. A wireless device comprising at least one of a transmitter and a receiver, further comprising a surface-mounted antenna coupled to the at least one of a transmitter and receiver, the surface-mounted antenna comprising:

a dielectric base member;

a feeding element formed by extending a radiation electrode from a feeding terminal on the dielectric base member; and a non-feeding element formed by extending a radiation electrode from a ground terminal on the dielectric base member, the feeding element and the non-feeding element being arranged with a distance therebetween;

wherein at least one of the feeding element and the non-feeding element comprises a branched element formed by extending a plurality of radiation electrodes branched from at least one of the feeding terminal and the ground terminal with a distance therebetween.

32. The wireless device of claim 31, further wherein the plurality of radiation electrodes forming the branched element has different fundamental wave resonance frequencies.

33. The wireless device of claim 31, further wherein the plurality of radiation electrodes forming the branched element is extended from the at least one of the feeding terminal and the ground terminal in directions in which the distance between the radiation electrodes is expanded.

34. The wireless device of claim 31, further wherein at least one of the plurality of radiation electrodes forming the feeding element and the non-feeding element locally includes at least one of a fundamental-wave controlling unit for controlling a fundamental-wave resonance frequency and a harmonic controlling unit for controlling a harmonic resonance frequency.

35. The wireless device of claim 34, further wherein the fundamental-wave controlling unit is locally disposed in a fundamental-wave maximum resonance current region including a maximum current portion at which a fundamental-wave resonance current reaches a maximum on a current path of the radiation electrode, and the harmonic controlling unit is locally disposed in a harmonic maximum resonance current region including a maximum current portion at which a harmonic resonance current reaches a maximum on the current path of the radiation electrode.

36. The wireless device of claim 31, further wherein the feeding element includes a region of a small electric length per unit length and a region of a large electric length per unit length, these regions being alternately arranged in series along the current path.

37. The wireless device of claim 31, further wherein at least one of the branched radiation electrodes of one of the feeding element and the non-feeding element performs combined resonance with a radiation electrode of the remaining element.

38. The wireless device of claim 31, further wherein electric power is supplied to the feeding terminal of the feeding element by capacitive coupling.

* * * * *